United States Patent [19]

Ivanov

[11] 3,967,786

[45] July 6, 1976

[54] MACHINE FOR WINDING SMALL-SIZE TOROIDAL CORES

[76] Inventor: Leonid Alexandrovich Ivanov, ulitsa Borodulina, 13, kv. 3, Rybinsk, U.S.S.R.

[22] Filed: Apr. 3, 1975

[21] Appl. No.: 564,886

Related U.S. Application Data

[63] Continuation of Ser. No. 408,427, Oct. 23, 1973, abandoned, which is a continuation of Ser. No. 241,796, April 6, 1972, which is a continuation of Ser. No. 87,399, Nov. 6, 1970, abandoned.

[52] U.S. Cl. ..... 242/4 R

[51] Int. Cl.[2] ..... B65H 81/02

[58] Field of Search ..... 242/4 R, 4 A

[56] References Cited

UNITED STATES PATENTS 2,962,235 11/1960 Riddler ..... 242/4 R

FOREIGN PATENTS OR APPLICATIONS 928,593 6/1963 United Kingdom ..... 242/4 R 116,508 1/1959 U.S.S.R. ..... 242/4 R

*Primary Examiner*—Edward J. McCarthy

*Attorney, Agent, or Firm*—Holman & Stern

[57] ABSTRACT

A machine for winding small-sized toroidal coils on ring-shaped cores in which an end of a required length of wire is repeatedly passed through a ring core to produce a toroidal coil. Such machines include a generally disk-shaped stationary member with the rim thereof being adapted to guide at least a portion of the wire being wound. There is also a roller device which places a portion of the wire at its free end on the rim of the disk intermittently during the winding operation. Wire breakage has been known to occur due to the extensive area of contact of the wire on the rim and the friction therebetween. This invention overcomes this disadvantage by providing a plurality of projections on the rim periphery, thus reducing the area of contact of the wire and the friction. A mechanism is also provided for pulling a free end of the winding wire through the ring-shaped core.

2 Claims, 7 Drawing Figures

MACHINE FOR WINDING SMALL-SIZE TOROIDAL CORES

This is a continuation of application Ser. No. 408,427 filed Oct. 23, 1973, now abandoned, which in turn is a continuation of Ser. No. 241,796 filed Apr. 6, 1972, which in turn is a continuation of Ser. No. 87,399 filed Nov. 6, 1970, now abandoned.

BACKGROUND OF THE INVENTION

The present invention relates to the machine-tool building industry and more specifically to the machines for winding small-sized toroidal cores.

PRIOR ART

Known in the art are machines for winding small-size toroidal coils on ring-shaped cores by pulling a free end of a measured length of wire many times through the hole in the core with a hook to wind the wire. Each time after pulling the wire through the hole in the core, the free end of the wire is placed by a roller device on a guide whose role is fulfilled by the rim of a stationary disc, in order to create a spare length of the wire required for the next operation of pulling through the free end of the wire. The wire is held on the guide by means of hold-down devices.

A disadvantage of these machines is that they can be used with a piece of wire not longer than 300 mm. This limits the number of turns which can be wound on a toroidal core; with a relatively larger size of the core the number of turns obtained may prove insufficient.

The length of the piece of wire on the known machines cannot be increased because this would call for increasing the length of the guide, i.e. the circumference and hence the diameter of the disc. This hampers greatly the release of the wire from the guide, thus inevitably leading to wire breakages.

OBJECTS AND SUMMARY OF THE INVENTION

An object of the invention resides in eliminating the disadvantages of the known machines.

The main object of the invention is to reduce the contact surface between the wire and the guide.

This object is accomplished by providing a machine for winding small-size toroidal cores in which there is a device for pulling the free end of the wire through the central hole in the core and a device for placing the end of the wire pulled through the core on a substantially disk-shaped guide to create a spare length of the wire for the next pull-through operation, and in which the wire is held on the periphery of the guide with the aid of the hold-downs in which, according to the invention, the guide is constituted by a disk-shaped means with a plurality of peripheral spaced, protruding ribs, a certain distance from one another.

Such a design of the guide ensures a decreased contact and less friction between the wire and the guide which makes it possible to increase the wire length. Now the invention will be described in detail by way of an example with reference to the drawings in which:

DETAILED DESCRIPTION OF THE PREFERRED EMBODIMENT

Figure 5:
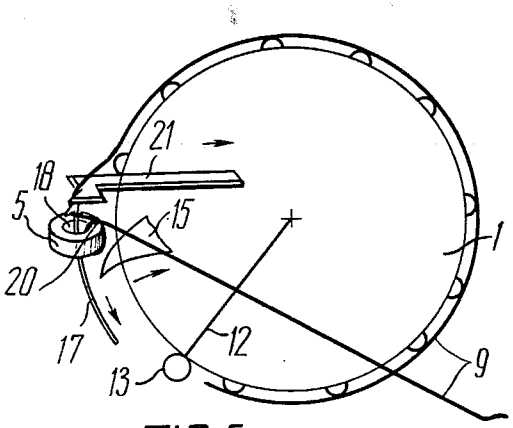

The machine comprises a stationary disk 1 having a rim 2 provided with semi-cylindrical elements or projections 3 (FIGS. 1 and 5), with the projections being spaced from one another. A device 4 serves to retain and rotate a core 5 while it is wound with wire. A device 6 serves to catch the end of the wire and pull it through a hole 18 of the core 5. The device 6 is kinematically linked with a master drive 7 and a device 8 serves for placing the free end of the wire on the projections 3 of the disk 1.

Figures 1, 1A, 1B:
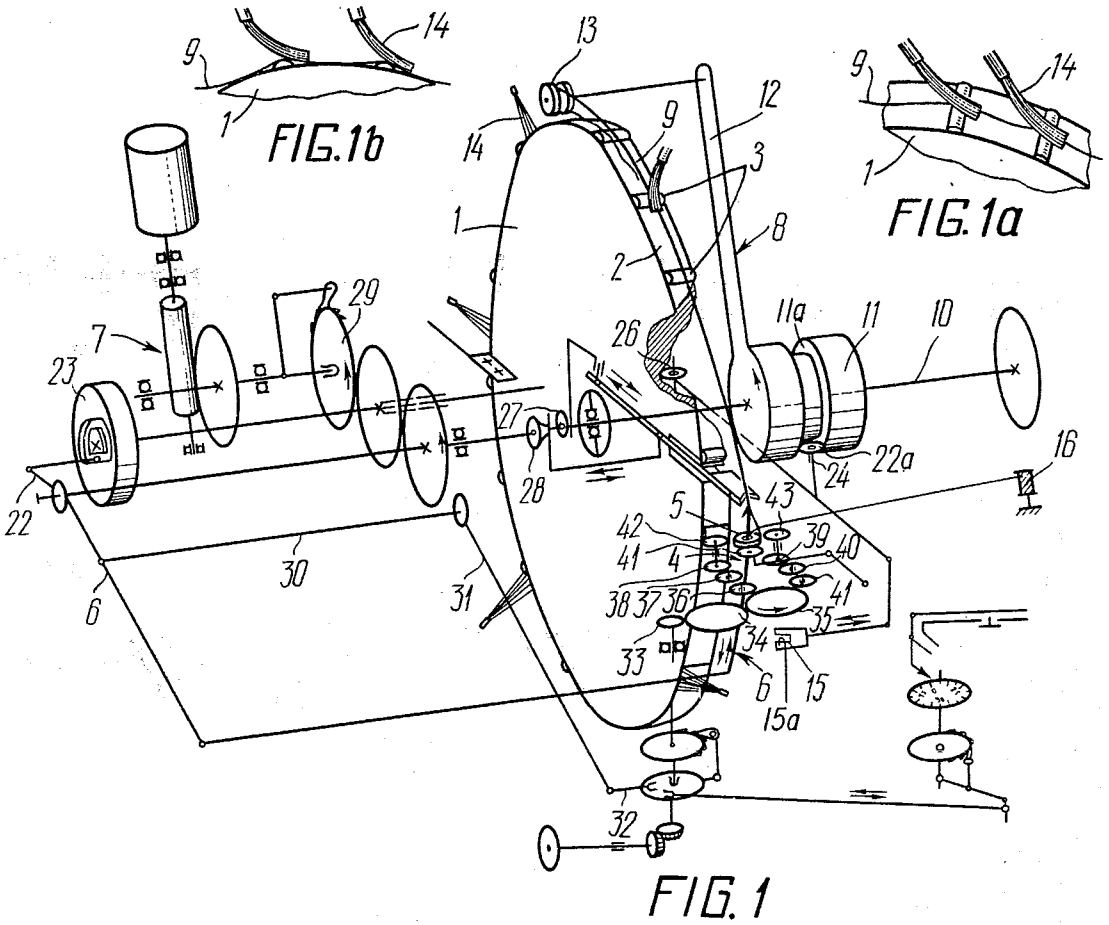
FIG. 1 is a power train diagram of the machine for winding small-size toroidal cores, according to the invention.
FIGS. 1*a* and 1*b* are fragmentary views in perspective and elevation respectively showing the co-action between the hold-down brushes and the wire.
Figure 2:
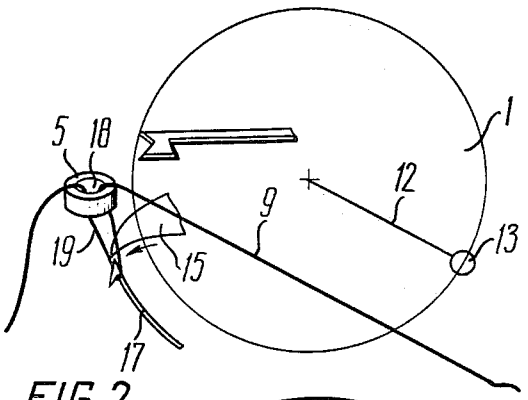
FIGS. 2, 3, 4 and 5 show various positions of the free end of the wire on the wire guide in the process of winding (for the sake of clarity one branch of the wire for winding is shown in FIG. 5 higher than the other branch though it should actually lie also on the rim of the disc).
Figure 4:
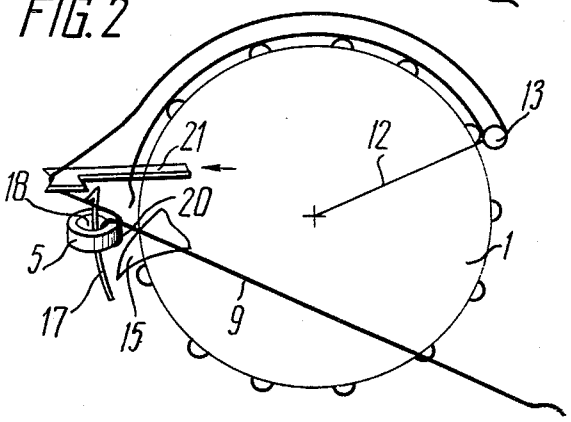

The device 8 includes a cam 11 secured on a drive shaft 10 (FIG. 1). The cam 11 is provided with a drive link 12 which is a strip coupled ridigly with the cam and the link carries a roller 13 which runs over the horizontal surface of the stationary disk 1, pulling the free end of the wire 9.

The device 4 includes three vertical rollers 42, 43, and 44. The rollers 42 and 43 are driving rollers, while the roller 44 is a freely rotating roller. The roller 44 is movably mounted on the housing of the device (not illustrated) to move in a horizontal direction. This movement is necessary in order to insert the core 5 between the rollers 42 and 43. The roller 44 is moved manually against the resistance of a spring (not shown) to prevent a spontaneous movement of the roller. The driving rollers 42 and 43 are rotated via a system of gear wheels 33-41 which system in turn is actuated from a ratchet gear 29 rotated by the shaft of the master drive 7 through a system of levers 22, 30, 31 and 32 operably associated with the pull-through device 6.

More particularly, the pull-through device 6 is provided with a hook 17 which constitutes the working member thereof and which is caused to reciprocate from the system of levers 22, 30, 31 and 32 which rotates the ratchet gear 29.

The wire 9 is retained on the projections 3 by special devices in the form of hold-down brushes 14 (FIG. 1). Linked kinematically with the cam 11 is a shuttle 15 (FIGS. 1 through 5) intended to widen the loop and bring it to the roller 13 of the device 8.

The shuttle 15 is caused to reciprocate releasing the hook 17 from loop 19 (FIG. 2) and the shuttle is fixed at one end of a lever 25. The other end of the lever denoted 26 is pivoted on the machine housing. A lever 24 engages, via a roller 22a, a shaped groove 11a, of the cam 11 so that the lever 25 oscillates in a horizontal plane and the shuttle 15 accordingly reciprocates horizontally. From the above, it will be appreciated that with the assistance of the cam 11 and the levers 24 and 25, the shuttle 15 is caused to reciprocate releasing the hook from the loop 19.

Figure 3:
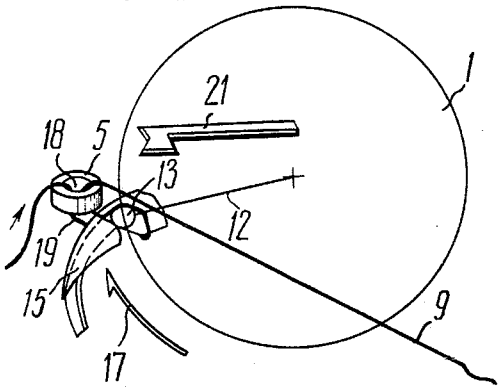

The shuttle 15 has a tapered configuration (FIG. 1) and is provided with a transverse slot 15a for the passage of roller 13 serving to catch the loop 19 of the wire (FIG. 3). The tapered portion of the shuttle 15 is employed to widen the loop 19 formed as a result of the wire being gripped and pulled through the ring-shaped core by the hook 17.

A catcher 21 assists the hook 17 in catching the wire 9 and the catcher 21 executes a complex oscillatory motion in a horizontal plane from the cams 27 and 28 secured on the shaft 10.

The machine operates as follows:

A measured length of the wire 9, one end of which is secured to a reel 16 fixed on the housing (FIG. 1) is brought under the hook 17 (FIGS. 2 through 4) of the pull-through device 6. The hook 17 catches the wire 9 and pulls it through the hole 18 in the toroidal core 5, forming the loop 19. Then, the tapered portion of the shuttle 15 widens the loop 19 and brings it to the roller 13 which, being moved by the drive link 12 around the disc 1, takes up the loop 19 and, lifting it forms a turn 20 (FIG. 5) around the core 5.

During the movement of the roller 13 along the rim of the disc, the free end of the wire is pulled through the hole 18 in the core and is placed on the disc 1 on one of the elements 3. During the further movement of the roller 13 the loop 19 is completely straightened and the free end of the wire is placed along the rim 2 of the disc 1 over the crests of the projections 3. Then, the wire 9 is thrown by the working stroke of the catcher 21 (FIGS. 1-5) on the hook 17 which, making the next working stroke, again pulls the wire 9 through the hole 18 of the core 5.

Then, the entire operating cycle is repeated as described above and the free end of the wire, overcoming the grip of the brushes, is gradually used up.

It will be appreciated that since the projections 3 are disposed along the rim 2 in a circular row in spaced relationship to one another, the total area of contact between the wire and the guide means is reduced to the minimum possible as illustrated in FIGS. 1*a* and 1*b*. This is especially important when the wire is repeatedly pulled off from the guide means, since the danger of the wire insulation being damaged and the wire per se broken is eliminated, even though the wire has a considerable length. By virtue thereof, the present machine is capable of winding a cut-length of up to 1.5m while the maximum length of wire wound in known machines is 30cm.

The drive 7 includes an electric motor and a worm reducing gear, and being an independent mechanism, the drive is secured on a plate which also carries the stationary disk 1.

The shaft 10 rotates in an antifriction bearing provided in the center of disk 1 by the drive 7 via suitable gears.

With such a design of the guide disc the latter can be made very large, in fact, as large as practicable, and the length of the wire can also be greatly increased, depending on the size of the disc.

The disc shape of the guide element is most efficient, though said element may have another shape and design without affecting the essence and effect of the invention.

What we claim is:

1. In a machine for winding toroidal coils on ring-shaped cores, in which the end of a wire length is passed in a form of a loop through a ring-shaped core which is so fixed as to turn gradually around its axis to form a toroidal core, the machine comprising means for pulling one end of the wire through the ring-shaped core, a disk-shaped fixed guide element having a cylindrical surface on which at least part of the wire length being wound on the core is retained, retaining means for retaining part and the end of the wire on the cylindrical surface of the disk-shaped guide element, means for widening the free end of the wire pulled through the ring-shaped core, and means for locating the free end of the wire pulled through the ring-shaped core, the improvement including a plurality of spaced projections on the cylindrical surface of the disk for guiding the wire, with the projections reducing to a minimum, the total contact area between the wire and the guide element.

2. The toroidal coil winding machine as claimed in claim 1 in which said projections are semi-cylindrical.

* * * * *